US005689143A

United States Patent [19]

Nikles

[11] Patent Number: 5,689,143

[45] Date of Patent: Nov. 18, 1997

[54] ARRANGEMENT OF RESISTORS FOR SWITCHING OF CAPACITIVE LOADS IN AN ELECTROMAGNETIC SWITCHING DEVICE

[75] Inventor: Rudolf Nikles, Oberentfelden AG, Switzerland

[73] Assignee: Allen-Bradley Company, Inc., Milwaukee, Wis.

[21] Appl. No.: 658,328

[22] Filed: Jun. 5, 1996

[30] Foreign Application Priority Data

Jun. 9, 1995 [CH] Switzerland ..... 01711/95

[51] Int. Cl.[6] ..... H01H 33/14

[52] U.S. Cl. ..... 307/109; 307/137

[58] Field of Search ..... 307/109, 132 R, 307/132 E, 137, 135, 141.4; 361/160, 166, 191, 206, 58, 15–17; 338/279, 280, 283, 287, 271, 292; 200/243, 250

[56] References Cited

U.S. PATENT DOCUMENTS 3,697,923 10/1972 Griffes ..... 338/280

4,437,020 3/1984 Schröther ..... 307/135

4,529,958 7/1985 Person et al. ..... 338/280

4,623,767 11/1986 Schulz ..... 338/292

*Primary Examiner*—Richard T. Elms

*Attorney, Agent, or Firm*—John M. Miller; John J. Horn

[57] ABSTRACT

The arrangement of resistors is intended for the switching of capacitive loads in an eletromagnetic switching device with main contacts (3) and auxiliary contacts (4). One of the terminals (7) of the auxiliary contacts (4) and one of the terminals (6) of the main contacts of the same phase are located above each other on the same side of the switching device. The auxiliary contacts (4) close before the main contacts (3) and open after same. A rigid resistor (8) is connected between the terminals (6) and (7) of each phase. The rigid resistor (8) facilitates upgrading of existing electromagnetic switching devices (1) with resistors (8) that are required for switching of capacitive loads.

6 Claims, 3 Drawing Sheets

ARRANGEMENT OF RESISTORS FOR SWITCHING OF CAPACITIVE LOADS IN AN ELECTROMAGNETIC SWITCHING DEVICE

FIELD OF INVENTION

The present invention relates to an arrangement of resistors in an electromagnetic switching device utilized for switching capacitive loads, whereby the switching device is equipped with parallel wired main contacts and auxiliary contacts. At least one of the terminals of the auxiliary contacts, and at least one of the terminals of the main contacts are positioned above each other on the same side of the switching device, and between the terminals of main and auxiliary contacts of each phase is a (Ohm type) resistor, whereby the auxiliary contacts will be closed before, and opened after the main contacts.

BACKGROUND OF THE INVENTION

According to EP-B1-0058235, an electromagnetic switching device of the type mentioned earlier is known. On this switching device, insulated wire-wound resistors are connected at each phase between the terminals of the main and auxiliary contacts. Wire-wound resistors have the characteristics of inadequate stability and, therefore, must be limited in their movements by means of layers of insulating material between adjacent phases and towards both edges of the switching device. For this reason, existing electromagnetic switching devices without layers of insulating material cannot be upgraded retroactively with resistors between the main and auxiliary contacts in order to be used for switching of capacitive loads. Furthermore, the wire-wound resistors in switching devices vibrate when exposed to shock, resulting in bending loads to the resistor leads at the binding posts, which shortens the switching device life span due to fatigue breaks. Installation of those unstable resistors that are wound with resistive wire is difficult, as they must be held and guided at both ends.

SUMMARY OF INVENTION

The task of the presented invention is to develop an arrangement of resistors in an electromagnetic switching device for switching of capacitive loads, such that each switching device can be upgraded any time with resistors that are required for switching of capacitive loads, where the resistor has a relatively long life span, and simple installation is possible.

The presented task is solved by utilizing a rigid resistor between the terminals of the main contacts and the auxiliary contacts. With rigid resistors, upgrading of electromagnetic switching devices without insulating layers as side limit is possible. The switching device upgraded with resistors is suitable for switching of capacitive loads. Also, the life span of this setup is relatively long because the resistor directly installed between the binding posts of the main and auxiliary contacts does not vibrate, thus avoiding mechanical loads and fatigue breaks. Installation of the rigid resistor is simple and can be implemented with just one holding device.

Each resistor has the advantage of being stamped from a rigid resistive material sheet metal. Economic advantages can be achieved with the stamped resistive sheet metal. The resistive sheet metal is, advantageously, shaped in a meander pattern. The meander shape facilitates a good adjustment of the resistance to the required value.

The ends of sheet metal resistors can be clamped directly under the binding posts. The ends of sheet metal resistors are shaped accordingly and may be fastened directly to the terminals without spade clips.

As an advantage, each resistor is housed under a rigid protective safety cover. The rigid protective safety cover is made of insulating material and ensures, through the area that surrounds the resistor, that the voltage carrying resistor cannot be touched inadvertently.

DETAILED DESCRIPTION OF THE PREFERRED EMBODIMENT

Figure 1:
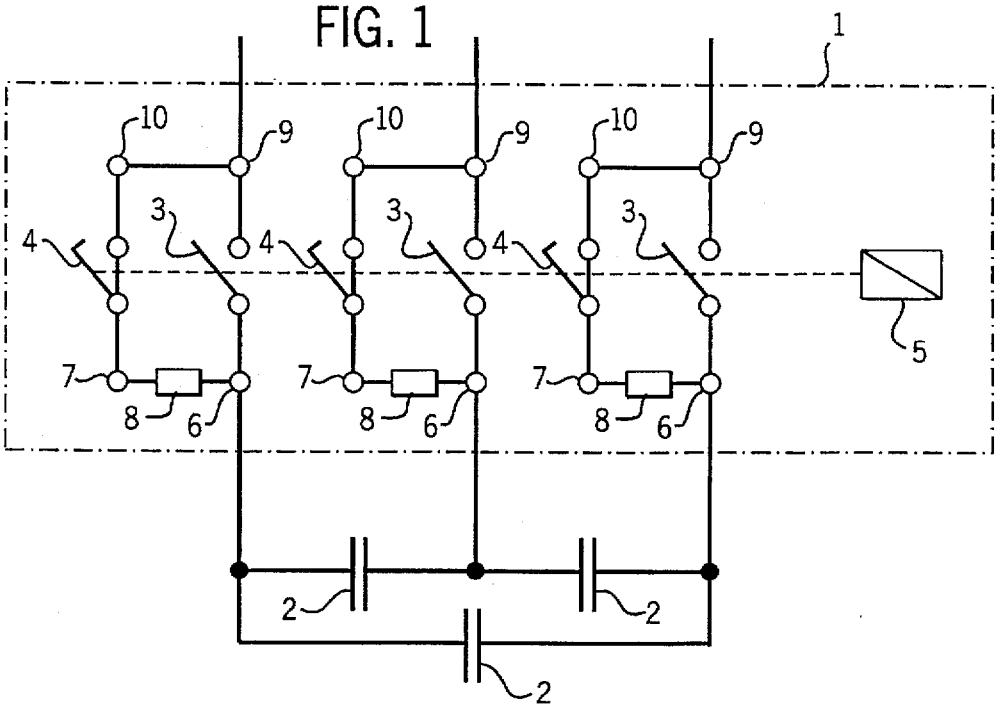
FIG. 1 is a circuit diagram of an electromagnetic switching device with a capacitive load in accordance with the present invention.

The wiring diagram in FIG. 1 shows an electromagnetic switching device 1 with a capacitive load created by three capacitors 2. The electromagnetic switching device 1 is equipped with main contacts 3 and auxiliary contacts 4, which are activated by an electromagnet 5. Thus, the auxiliary contacts 4 close before the main contacts 3 and open after the main contacts 3. For each phase, a resistor 8 is connected between the terminals 6 of the main contacts 3 and the terminals 7 of the auxiliary contacts 4. The other terminals 9, 10 of the main and auxiliary contacts 3, 4 are electrically connected in each phase. The main and auxiliary contacts 3, 4 are wired in parallel through resistor 8.

Figure 2:
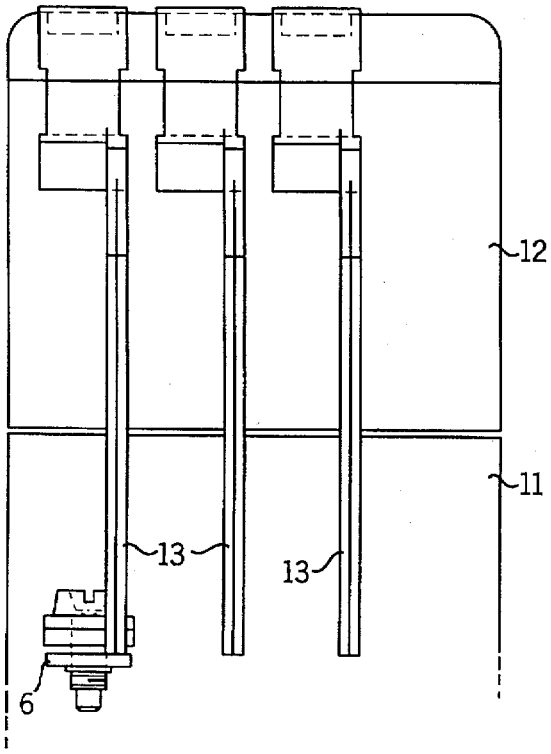
FIG. 2 is a partial from views of an electromagnetic switching device in accordance with the present invention
Figure 3:
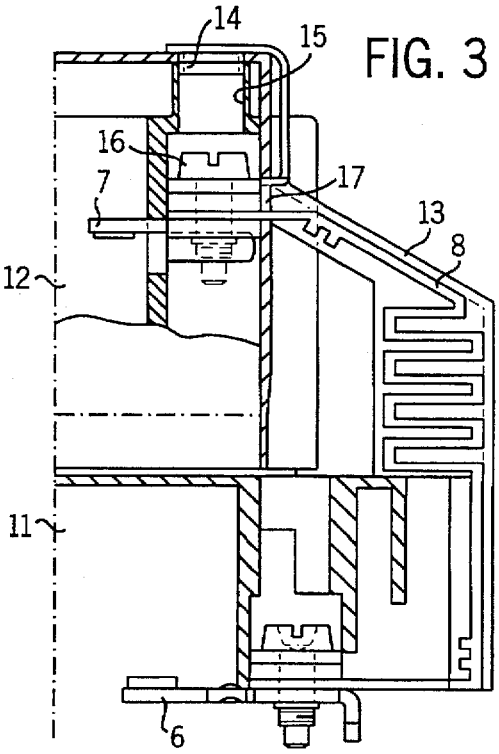
FIG. 3 is a partial cross-sectioned side view of an electromagnetic switching device with a meander-shaped resistor, in accordance with the present invention.

FIG. 2 illustrates a partial front view of the electromagnetic switching device 1. The trace of the housing 11 surrounding the main contacts 3, and the trace of the housing 12 surrounding the auxiliary contacts 4 can be recognized in this Figure. FIG. 3 shows part of the electromagnetic switching device 1 in side view, partially in cross-section. The terminals 7 of auxiliary contacts 4 are positioned above the terminals 6 of the main contacts 3 of the same phase. In each phase, a resistor 8 is connected between terminals 6 and 7 of the main and auxiliary contacts 3 and 4. The resistor 8 is made of a flat, rigid, stamped resistive material. The rigid resistor 8 facilitates upgrading of practically every electromagnetic switching device with a resistor between the terminals of the main and auxiliary contacts. The rigid resistor 8 does not vibrate during the switching motions of the switching device, so that fatigue breaks are not to be expected at the binding posts of resistor 8. Also, the rigid resistor 8 can easily be installed by utilizing a simple clamping device for the installation because the terminals are distanced firmly.

Figure 5:
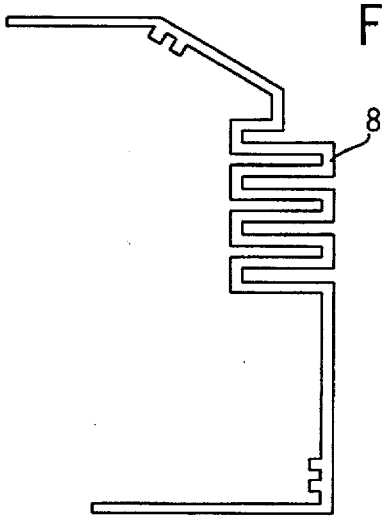
FIG. 5 is a meander-shaped stamped resistor in accordance with the present invention

As can be seen in FIG. 5, the resistor 8 is meander-shaped. The meander shape is advantageous because calibration to the desired resistance value is relatively simple and possible with the meander shape.

The ends of the resistors 8 are fastened directly under the terminal clamps 6, 7 of the main and auxiliary contacts 3, 4. Additional spade clips are not required for the connection of the resistors 8.

Figure 6:
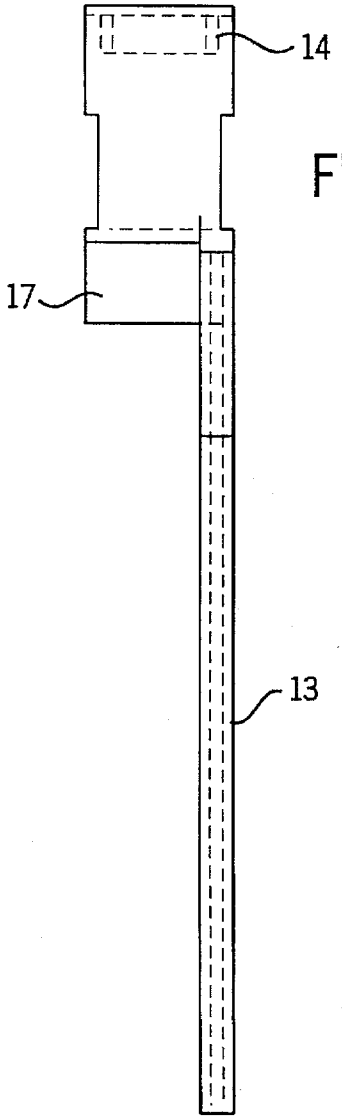
FIG. 6 is a front elevational view of a touch protection safety cover.
Figure 7:
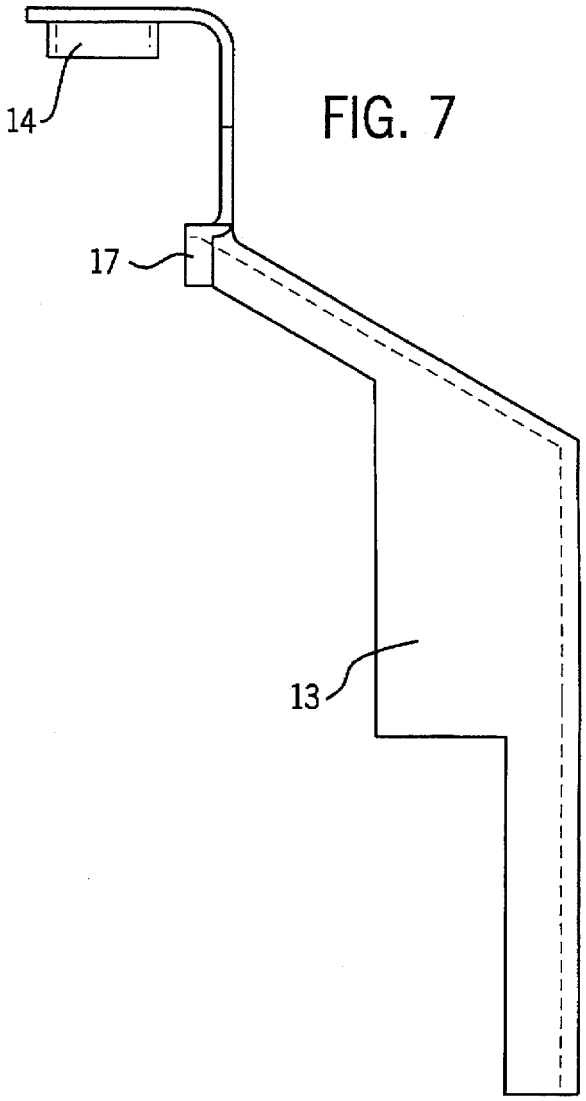
FIG. 7 is a side view of the touch protection safety cover.

Each resistor 8 is enclosed in a rigid touch protection safety cover 13. On the top, this touch protection safety cover 13 is suspended with a stud 14 in the opening 15 of terminal screw 16 of terminal 7 of the auxiliary contact 4, and pressed into the terminal opening of terminal clamp 7 with a broad shoulder 17. For this, FIGS. 6 and 7 should also be examined.

Figure 4:
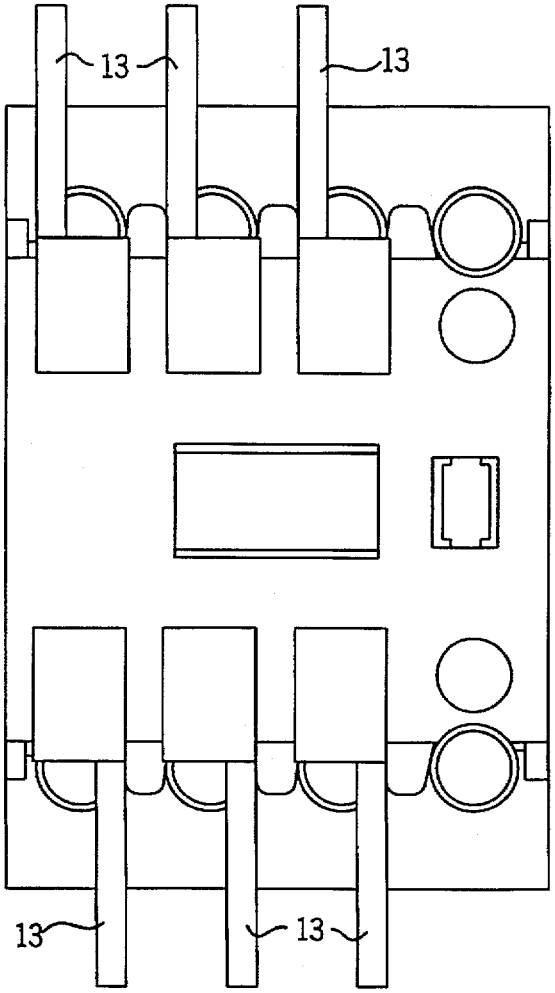
FIG. 4 is a top view of the electromagnetic switching device, in accordance with the present invention.

In FIG. 4, the electromagnetic switching device 1 is recognized in top view. The touch protection of the terminals 6 and 7 of the main and auxiliary contacts 3, 4 is ensured through the mounted touch protection safety covers 13.

I claim:

1. An electromagnetic switching device used to switch capacitive loads comprising:

a main contact, said main contact comprising a first main contact terminal and a second main contact terminal;

an auxilary contact, said auxilary contact comprising a first auxilary contact terminal and a second auxilary contact terminal, said first main contact terminal located proximal said first auxiliary contact terminal and said second main contact terminal connected to said second auxiliary contact terminal;

a rigid unitary planar resistor connected between said first main contact terminal and said second auxiliary contact terminal;

whereby in use said auxiliary contact closes before the main contact and opens after the main contact.

2. The electromagnetic switching device as set forth in claim 1 wherein the rigid resistor is made of stamped resistive sheet metal.

3. The electromagnetic switching device as set forth in claim 2 wherein the resistive sheet metal is meander-shaped.

4. The electromagnetic switching device as set forth in claim 2 wherein the the rigid planar resistor is fastened directly under the first main contact terminal and the first auxiliary contact terminal.

5. The electromagnetic switching device a set forth in claim 1 wherein the rigid resistor is located in a rigid touch protection housing.

6. The electromagnetic switching device as set forth in claim 4 wherein the rigid resistor is located in a rigid touch protection housing.

* * * * *